US011773550B2

(12) United States Patent
Lee et al.

(10) Patent No.: US 11,773,550 B2
(45) Date of Patent: Oct. 3, 2023

(54) ROTATIONAL DECK WITH SHOCK-REDUCING FRONT BLOCK OF EMERGENCY VEHICLE RETURN APPARATUS FOR MEDIAN STRIP

(71) Applicant: DIGITAL & SECURITY TECHNOLOGY CO., LTD., Seoul (KR)

(72) Inventors: Won Woo Lee, Seoul (KR); Seung Ryul Lee, Goyang-si (KR)

(73) Assignee: DIGITAL & SECURITY TECHNOLOGY CO., LTD., Seoul (KR)

( * ) Notice: Subject to any disclaimer, the term of this patent is extended or adjusted under 35 U.S.C. 154(b) by 296 days.

(21) Appl. No.: 17/101,649

(22) Filed: Nov. 23, 2020

(65) Prior Publication Data

US 2021/0317625 A1 Oct. 14, 2021

(30) Foreign Application Priority Data

Apr. 8, 2020 (KR) ..... 10-2020-0042604

(51) Int. Cl.
*E01F 15/12* (2006.01)
*E01F 15/14* (2006.01)

(52) U.S. Cl.
CPC ..... *E01F 15/12* (2013.01); *E01F 15/146* (2013.01)

(58) Field of Classification Search
CPC ..... E01F 15/12; E01F 15/146
See application file for complete search history.

(56) References Cited

U.S. PATENT DOCUMENTS 5,009,542 A * 4/1991 Hardin, Jr. ..... E01F 15/12 404/9
5,181,794 A * 1/1993 Wilson ..... E01F 15/12 404/6
5,551,796 A * 9/1996 Anderson, Jr. ..... E01F 15/12 404/6
5,586,355 A * 12/1996 Metz ..... B65G 69/2882 14/71.3
8,647,012 B2 * 2/2014 Wilkinson ..... E01F 15/12 404/6

FOREIGN PATENT DOCUMENTS

EP 0445995 A1 9/1991
JP 2004211340 A 7/2004
KR 1020050011154 A 1/2005
(Continued)

*Primary Examiner* — Gary S Hartmann
(74) *Attorney, Agent, or Firm* — You & IP LLC

(57) ABSTRACT

A rotational deck which is used for an emergency vehicle return apparatus in a section of a median strip of a road, includes a pair of angle decks configured to be folded up to serve as the median strip in a normal state, and be unfolded down by hydraulic cylinders toward a surface of the road to serve as a vehicle pass in an event of emergency, and a front block part coupled, by a link unit, to a lower portion of each angle deck. The front block part includes a front block having a shape to reduce a shock from a collision, one or more front block frames configured to provide rigidity by supporting a rear surface of the front block, and a bottom frame configured to support the front block and a lower portion of the front block frame.

8 Claims, 12 Drawing Sheets

(56) References Cited

FOREIGN PATENT DOCUMENTS

| | | | |
|---|---|---|---|
| KR | 1020070110459 | A | 11/2007 |
| KR | 100935426 | B1 | 1/2010 |
| KR | 101019601 | B1 | 3/2011 |
| KR | 1020130011119 | A | 1/2013 |
| KR | 101893138 | B1 | 8/2018 |

* cited by examiner

ROTATIONAL DECK WITH SHOCK-REDUCING FRONT BLOCK OF EMERGENCY VEHICLE RETURN APPARATUS FOR MEDIAN STRIP

CROSS-REFERENCE TO RELATED APPLICATIONS

This application claims the priority of Korean Patent Application No. 10-2020-0042604 filed on Apr. 8, 2020, in the Korean Intellectual Property Office, the disclosure of which is incorporated herein by reference.

BACKGROUND

Field

The present disclosure relates to a rotational deck with a shock-reducing front block of an emergency vehicle return apparatus for a median strip, and more particularly, to a rotational deck which is a component of an emergency vehicle return apparatus installed for each section of a median strip, in which the rotational decks, which are configured such that angle decks are symmetrically rotated toward two opposite roads in the event of emergency, each include a front block part capable of reducing impact to an occupant at the time of a vehicle collision.

Description of the Related Art

In general, median strips, which divide, for safety, roadways on which vehicles are driven in opposite directions, are provided in places, such as expressways or exclusive vehicle roads where the vehicles travel at a high speed. Such a median strip is constructed with poured concrete or steel guard rails along a centerline between the roadways.

Meanwhile, the median strip is provided with an emergency vehicle return section for allowing the return of the vehicle in the event of emergency, and an emergency vehicle return apparatus is installed to enable the vehicle, which travels along any one of the roadways, to go back along the opposite roadway in the event of emergency.

Various types of emergency vehicle return apparatuses are disclosed and typically include a type in which the emergency vehicle return apparatus is rotated about one point as an axis, a type in which the emergency vehicle return apparatus is slid through the median strip, or a type in which the emergency vehicle return apparatus is separated to provide emergency vehicle return sections.

However, the emergency vehicle return apparatus for a median strip in the related art has a drawback in that the emergency vehicle return apparatus needs to be controlled and the emergency vehicle return apparatus occupies a large space on a road when the emergency vehicle return apparatus is rotated and deployed in the event of emergency, a problem in that a constructional structure is complicated because separate sliding and fixing devices are required for the median strip in order to install the emergency vehicle return apparatus in a sliding manner along the median strip, a drawback in that the rotatable or slidable configuration is vulnerable to traffic safety at the time of a vehicle collision or the like because there is no supporting force on a ground layer at normal times for which the emergency vehicle return is not required, a drawback in that it is difficult to install the emergency vehicle return apparatus in accordance with a difference in height in a width direction and a longitudinal direction of a paved surface of the road, and a structural drawback in that it is difficult to smoothly operate the emergency vehicle return apparatus when operating the emergency vehicle return apparatus.

As a technology that solved the above-mentioned drawbacks, Korean Patent No. 10-1893138 granted to the present applicant discloses "Multi-Stage Emergency vehicle return apparatus for Median Strip Configured to Operate in Accordance with Difference in Height of Paved Surface of Road and with Load of Vehicle".

The technology includes: a base part constructed on the ground in one section of a median strip and configured to provide fixing force; a rotational deck part installed above the base part and configured such that a pair of angle decks is symmetrically installed and adjoins left and right paved surfaces of a road by being rotated by hydraulic cylinders, respectively; a cooperation part axially coupled so that the plurality of individual rotational deck parts operates in accordance with a difference in height of the paved surfaces of the road; a pressing/fixing part configured to elastically press the rotational deck part to fix the rotational deck part to the base part and configured to restrict a lifting height of the rotational deck part while providing buffer power when a local load of the vehicle is applied; a power control unit configured to provide hydraulic pressure and electric power for operating the rotational deck part to control the rotational deck part, in which the cooperation part includes: universal joints configured to connect rotational shafts of the angle decks provided in the individual rotational deck parts; a pair of gear shafts coupled to the pair of universal joints of the rotational deck part at one end among the rotational deck parts; a pair of cooperative gears axially coupled to the gear shafts and gear-coupled to the adjacent gear; and gear bushings configured to support the respective gear shafts.

The pre-registered technology of the present applicant configured as described above has various advantageous effects including an advantageous effect in that the angle decks are rotated by the hydraulic cylinders in the event of emergency so that the multi-stage rotational deck part and the respective angle decks are cooperatively operated and quickly unfolded with the rotational shafts of the angle decks, which are axially coupled to the angle decks, and the cooperative gears, such that the emergency return of the vehicle is enabled, an advantageous effect in that the cooperation part using the universal joint is provided to solve the problem in that a device for fastening the rotational deck part or the rotational shaft of the angle deck is damaged due to a difference in height in a width direction and a longitudinal direction of the paved surface of the road and the rotational deck part, an advantageous effect in that the pressing/fixing part is provided to restrict a lifting height while mitigating impact when the rotational deck part is raised due to a local of the vehicle that is making the return through the rotational deck part, and an advantageous effect in that the rotational deck part is configured to be restored to an original position after the vehicle passes therethrough, such that the stable operation may be performed.

Even though the above-mentioned technology has the advantageous effect of solving many problems of the emergency vehicle return apparatus in the related art, there is a problem in that since the angle decks positioned at both sides of the road have low collision resistance strength because of the structure in which the angle decks are installed vertically, such that when the vehicle collides with the emergency vehicle return apparatus at normal times when the emergency vehicle return is not required, the structure is deformed or a large amount of scattering components fractured at the time of the collision is generated, and there is also a problem in that impact is mostly transmitted to the inside of the vehicle at the time of the collision, which causes a deterioration in safety of an occupant.

The reason why the above-mentioned problems occur is that even though the vehicle needs to bounce out at a predetermined angle to reduce the impact generated at the time of the collision after the vehicle collides with the emergency vehicle return apparatus, the vertical deck structure in the related art cannot allow the vehicle to bounce out at a collision angle, but causes the vehicle structure to be deformed while maintaining the collision state, and the amount of scattering fractured components is increased.

Accordingly, there is a need for an emergency vehicle return apparatus that enables a vehicle, which collides with the emergency vehicle return apparatus, to bounce out at an angle corresponding to an incident angle after the vehicle collides with the emergency vehicle return apparatus.

DOCUMENTS OF RELATED ART

Patent Documents (Patent Document 1) Korean Patent No. 10-1893138 (Aug. 23, 2018)

(Patent Document 2) Korean Patent No. 10-0935426 (Dec. 28, 2009)

(Patent Document 3) Korean Patent No. 10-1019601 (Feb. 25, 2011)

(Patent Document 4) Korean Patent Application Laid-Open No. 10-2007-0110459 (Nov. 19, 2007)

SUMMARY

An object to be achieved by the present disclosure for solving the above problems is to provide a rotational deck which constitutes an emergency vehicle return apparatus installed along one section of a median strip and has a front block part, such that in the event of emergency, angle decks, which constitute the rotational deck, are rotated symmetrically toward both sides, respectively, so that a vehicle may make an emergency vehicle return through upper surfaces of the angle decks, and at normal times, the front block part positioned at a lower side of the angle deck allows the vehicle to bounce out while rotating at an angle corresponding to a collision incident angle at the time of a vehicle collision, thereby reducing structural deformation of the emergency vehicle return apparatus and the amount of scattering fractured components and reducing impact to be applied to an occupant in the vehicle.

Another object to be achieved by the present disclosure is to provide a rotational deck, in which an outer shape of a front block part is processed along a shape in which a lower section thereof protrudes or along a shape of a median strip, such that when an accident occurs in which a vehicle obliquely collides with the front block part at a predetermined angle, a wheel at a collision side climbs up a shaped surface of the front block part toward a road and reduces or cuts off power transmitted to the wheel at the collision side by a differential gear so that the vehicle bounces out while naturally rotating by power of the wheel at the other side, thereby reducing structural deformation of an emergency vehicle return apparatus and the amount of scattering fractured components and reducing impact to be applied to an occupant in the vehicle.

Still another object to be achieved by the present disclosure is to provide a rotational deck, in which a road-side external shape of an angle deck positioned at an upper side of a front block part is processed to have an inclined structure, such that when the vehicle collides with the angle deck at normal times, the angle deck assists the front block part in allowing the vehicle to bounce out at an angle corresponding to a collision incident angle, thereby reducing impact to be applied to an occupant.

Yet another object to be achieved by the present disclosure is to provide a rotational deck, in which a load of a front block part is applied as a load to a hydraulic cylinder after a predetermined time elapses in order to reduce force required for lifting during a process of switching an angle deck to an original position by operating the hydraulic cylinder after an emergency situation is ended.

According to an aspect of the present disclosure to achieve the object as described above and to perform the task for removing the conventional defects, there is provided a rotational deck with a shock-reducing front block of an emergency vehicle return apparatus for a median strip, which constitutes the emergency vehicle return apparatus installed for each section of a median strip of a road, the rotational deck including: a front block part fastened, by a link unit, to a lower portion of each of a pair of symmetrically installed angle decks of a rotational deck configured such that the pair of angle decks is rotated by hydraulic cylinders, respectively, and adjoins left and right paved surfaces of the road in the event of emergency, in which the front block part has a structure that serves as the median strip at normal times when the rotational deck does not operate, and reduces impact when a vehicle collides with the front block part.

In a preferred exemplary embodiment, the front block part may include: a front block having a shape in which a lower portion thereof further protrudes toward the road than an upper portion thereof; one or more front block frames configured to provide rigidity by supporting a rear surface of the front block and fastened, at one point, to the link unit installed on one or more angle deck frames for supporting the angle deck; and a bottom frame configured to support the front block and a lower portion of the front block frame.

In a preferred exemplary embodiment, the front block may have a cross-sectional structure having a “ 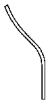 ” shape along an external shape of a cross section of the median strip.

In a preferred exemplary embodiment, the front block frame may be formed such that a horizontal deck frame, which connects the front block frames adjacent in an upper inward direction, is additionally formed, a plurality of left and right separation prevention protrusions may be welded on an outer surface of the horizontal deck frame and inserted between the angle deck frames for supporting the angle deck so that left and right movements are controlled, and the horizontal deck frame may have an obliquely processed portion formed at a rear portion of an upper surface thereof in order to avoid interference with the link unit provided on the angle deck frame when the left and right separation prevention protrusions are inserted between the angle deck frames.

In a preferred exemplary embodiment, the bottom frame may have a width (length) further protruding inward than a width (length) of the front block frame, a fixing protrusion protruding upward again may be formed in a longitudinal direction of the bottom frame and at an end thereof in an inner direction so that the fixing protrusion is supported by being inserted into a fixing groove formed in a fixing block that restricts a lifting height of a compression plate installed in a longitudinal direction of a base plate of a base part to which the rotational deck is fastened, and the fixing protrusion may have therein an elastic stopper at one point in the longitudinal direction.

In a preferred exemplary embodiment, the link unit may include: a block link fixed to the angle deck frame for supporting the angle deck; and a link connected, at one side thereof, to the block link by a pin and connected, at the other side thereof, by a pin, to a front block frame for supporting a front block of the front block part.

In a preferred exemplary embodiment, the link may be fastened to a long hole portion formed in the front block frame, and the link may be configured such that when the link unit is initially raised, a load of the front block part is not applied to the hydraulic cylinder, which rotates the angle deck, by a long hole length of the long hole portion.

In a preferred exemplary embodiment, the pair of angle decks may include outer and inner decks supported by a plurality of angle deck frames positioned inside the pair of angle decks, the outer deck may be formed in the form of a deck surface installed so that an upper portion thereof is inclined inward at a predetermined angle in order to prepare for a vehicle collision, the inner deck may be formed in the form of an inclined deck surface that becomes narrow outward from a lower portion thereof to an upper portion thereof from one section of the upper portion, the plurality of angle deck frames configured to support the angle deck may have shaft groove portions at lower sides thereof, and angle deck rotational shafts may be axially coupled to the shaft groove portions in a horizontal direction, such that the angle deck rotational shafts are operated in conjunction with the adjacent angle decks.

In a preferred exemplary embodiment, the angle deck may be coupled to the adjacent angle deck and configured to be cooperatively operated simultaneously as a connecting cover having a catching projection is installed or a catching groove configured to be caught by a catching projection is installed at left and right sides of the outer deck, and the angle decks positioned at both ends may have only one of the connecting cover and the catching groove in accordance with left and right positions.

According to the present disclosure having the above-mentioned features, in the event of emergency, the angle decks, which constitute the rotational deck of the emergency vehicle return apparatus installed along one section of the median strip, are rotated symmetrically toward both sides, respectively, so that the vehicle may make an emergency vehicle return through the upper surfaces of the angle decks, and when the vehicle obliquely collides with the angle deck at a predetermined at normal times, the front block part allows the vehicle to bounce out while naturally rotating at an angle corresponding to an incident angle as the wheel at the collision side climbs up the front block part and power transmission is cut off by the differential gear, thereby reducing structural deformation of the emergency vehicle return apparatus and the amount of scattering fractured components and reducing impact which occurs due to the collision and is to be applied to an occupant in the vehicle.

In addition, according to the present disclosure, the outer shape of the front block part is processed along a shape in which a lower section thereof protrudes or along a shape of the median strip, such that when an accident occurs in which a vehicle obliquely collides with the front block part at a predetermined angle, the wheel at a collision side climbs up a shaped surface of the front block part toward a road and reduces or cuts off power transmitted to the wheel at the collision side by a differential gear so that the vehicle bounces out while rotating by power of the wheel at the other side, thereby reducing structural deformation of an emergency vehicle return apparatus and the amount of scattering fractured components and reducing impact which occurs due to the collision and is to be applied to an occupant in the vehicle.

In addition, according to the present disclosure, the roadside external shape of the angle deck positioned at the upper side of the front block part is processed to have an inclined structure, such that when the vehicle collides with the angle deck at normal times, the angle deck assists the front block part in allowing the vehicle to bounce out at an angle corresponding to a collision incident angle, thereby reducing impact to be applied to an occupant.

In addition, according to the present disclosure, a load of the front block part is applied as a load to the hydraulic cylinder after a predetermined time elapses in order for the long hole portion formed in the angle deck frame fastened to the link unit to reduce force required for lifting during a process of switching the angle deck to an original position by operating the hydraulic cylinder after an emergency situation is ended.

The present disclosure is a useful invention having many advantages as described above and is an invention that is highly expected to be used in industry.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Hereinafter, configurations and operations of an exemplary embodiment of the present disclosure will be described in detail with reference to the accompanying drawings. In addition, in the description of the present disclosure, the specific descriptions of related well-known functions or configurations will be omitted when it is determined that the specific descriptions may unnecessarily obscure the subject matter of the present disclosure.

Figure 1:
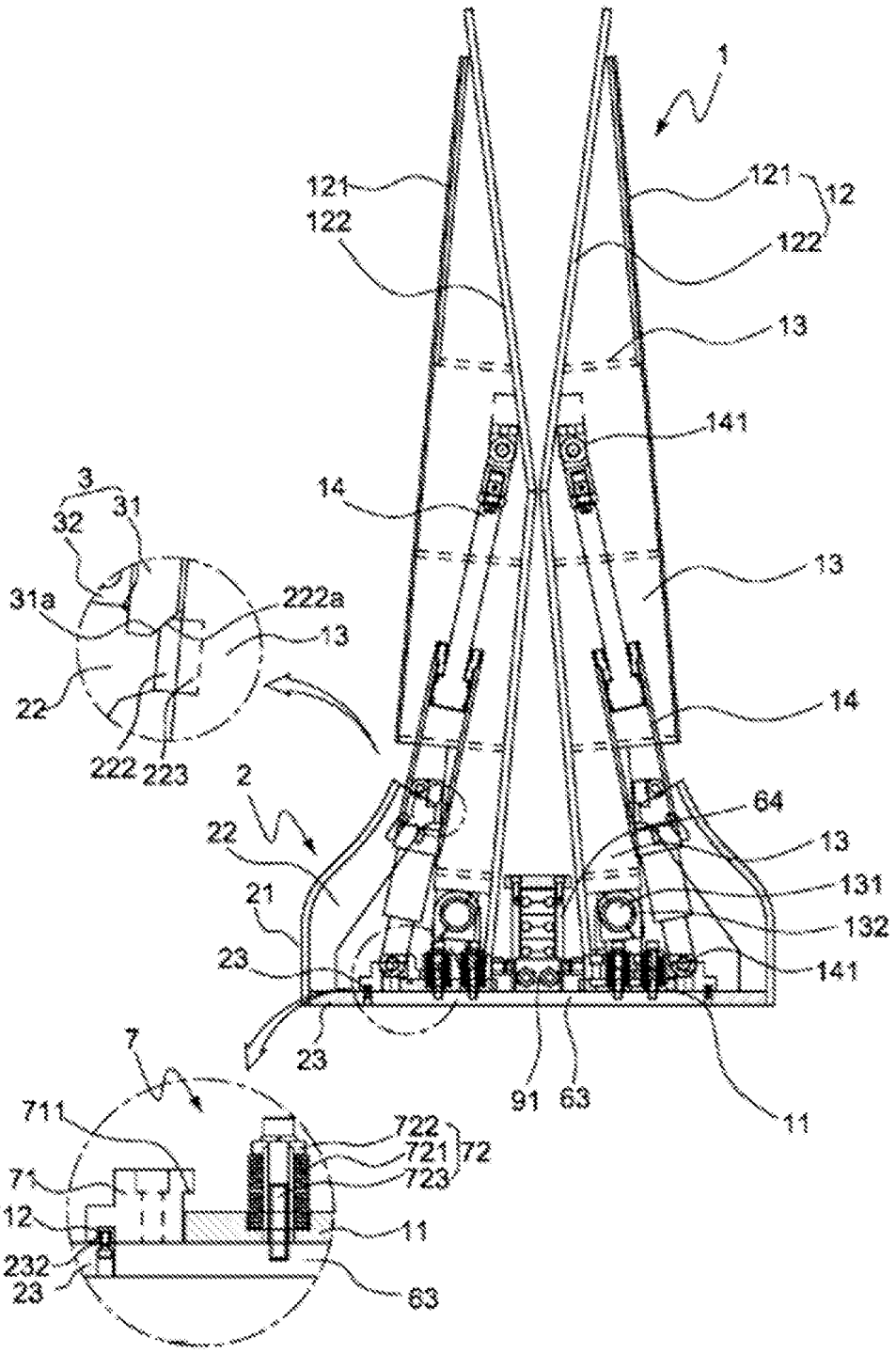
FIG. 1 is an exemplified cross-sectional view illustrating a configuration of an emergency vehicle return apparatus according to an exemplary embodiment of the present disclosure.
Figure 2:
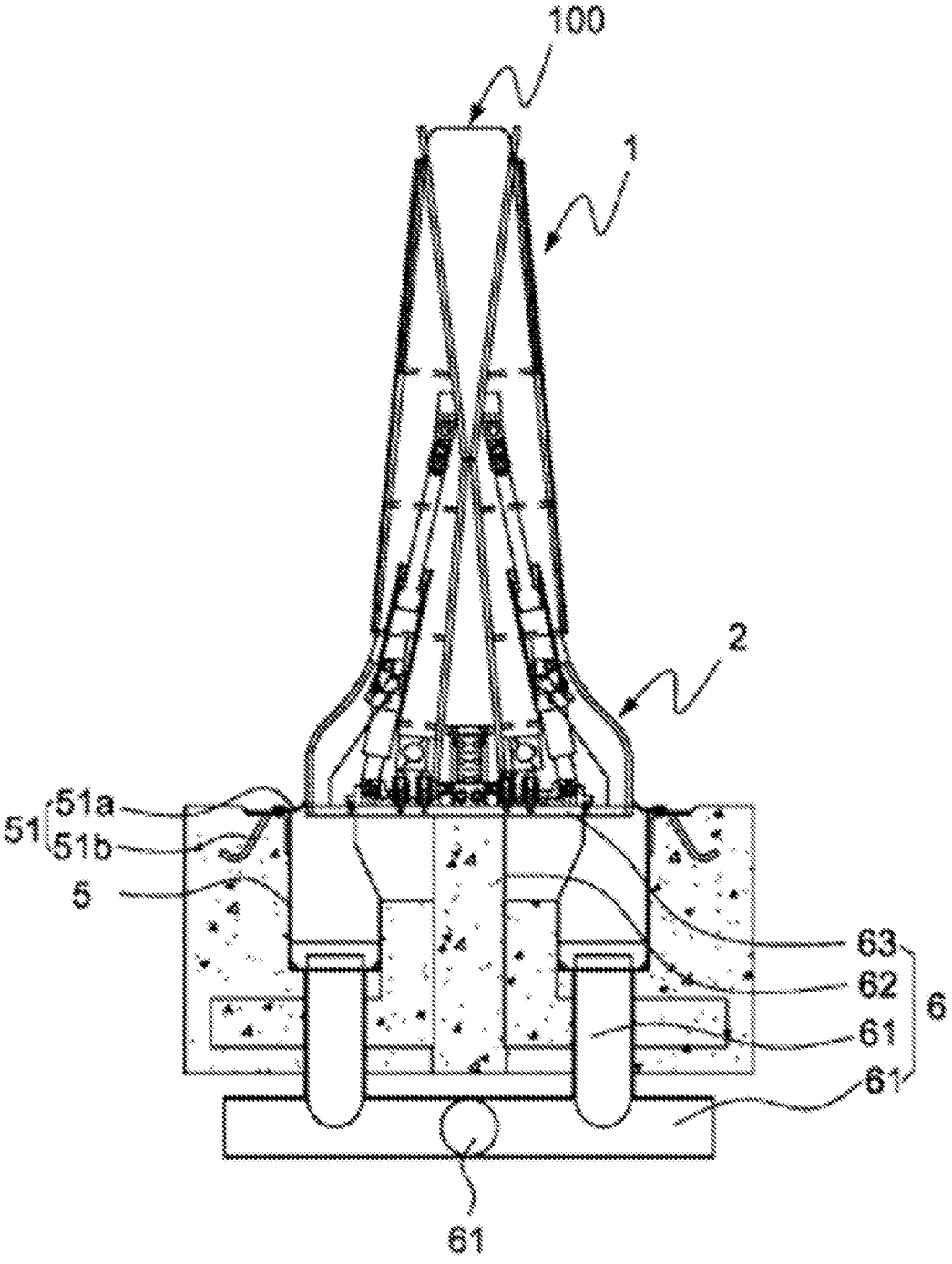
FIG. 2 is an exemplified cross-sectional view illustrating a structure in which the emergency vehicle return apparatus according to the exemplary embodiment of the present disclosure is constructed.
Figure 3:
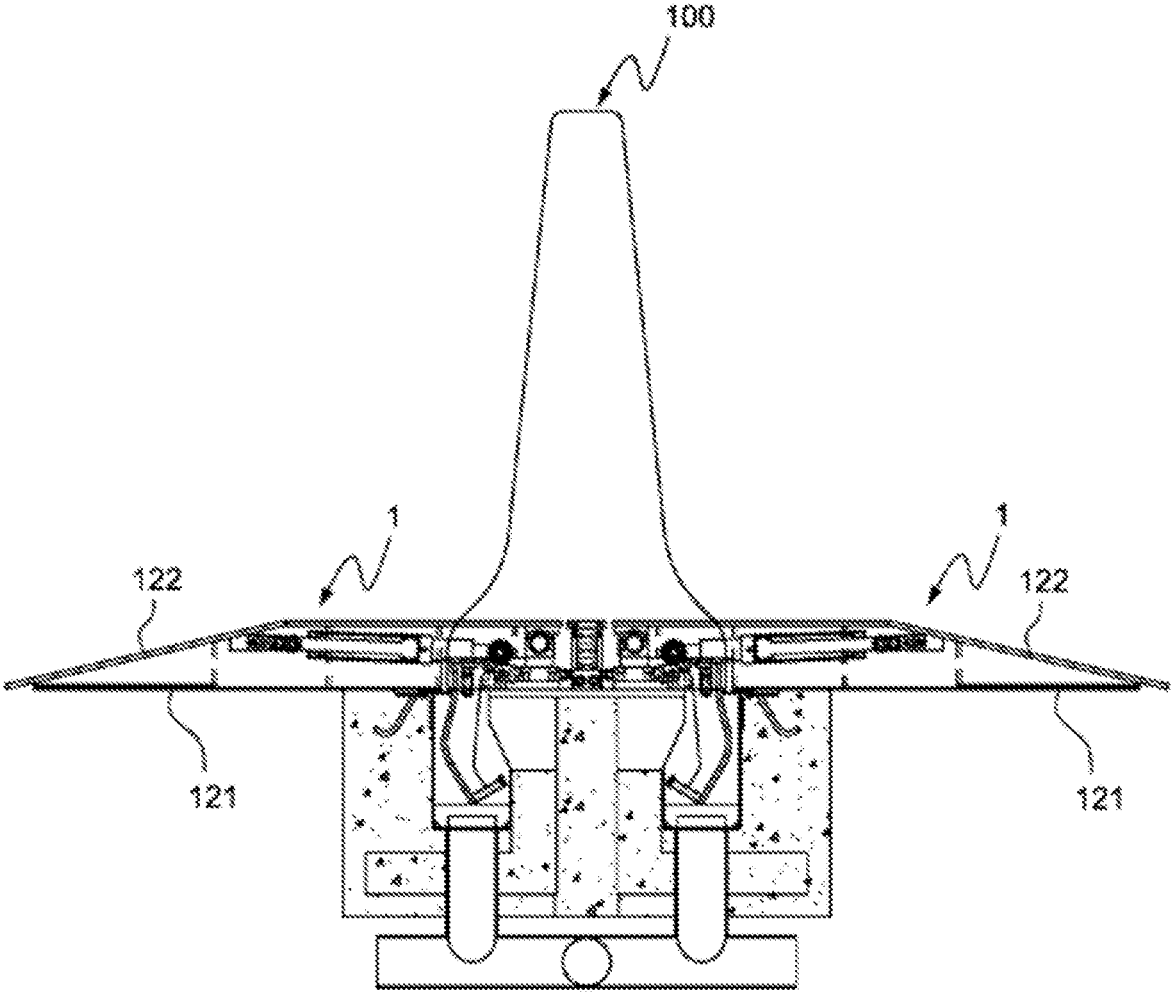
FIG. 3 is an exemplified cross-sectional view illustrating a state in which rotational decks of the emergency vehicle return apparatus according to the exemplary embodiment of the present disclosure are rotated and disposed horizontally in the event of emergency.
Figure 4:
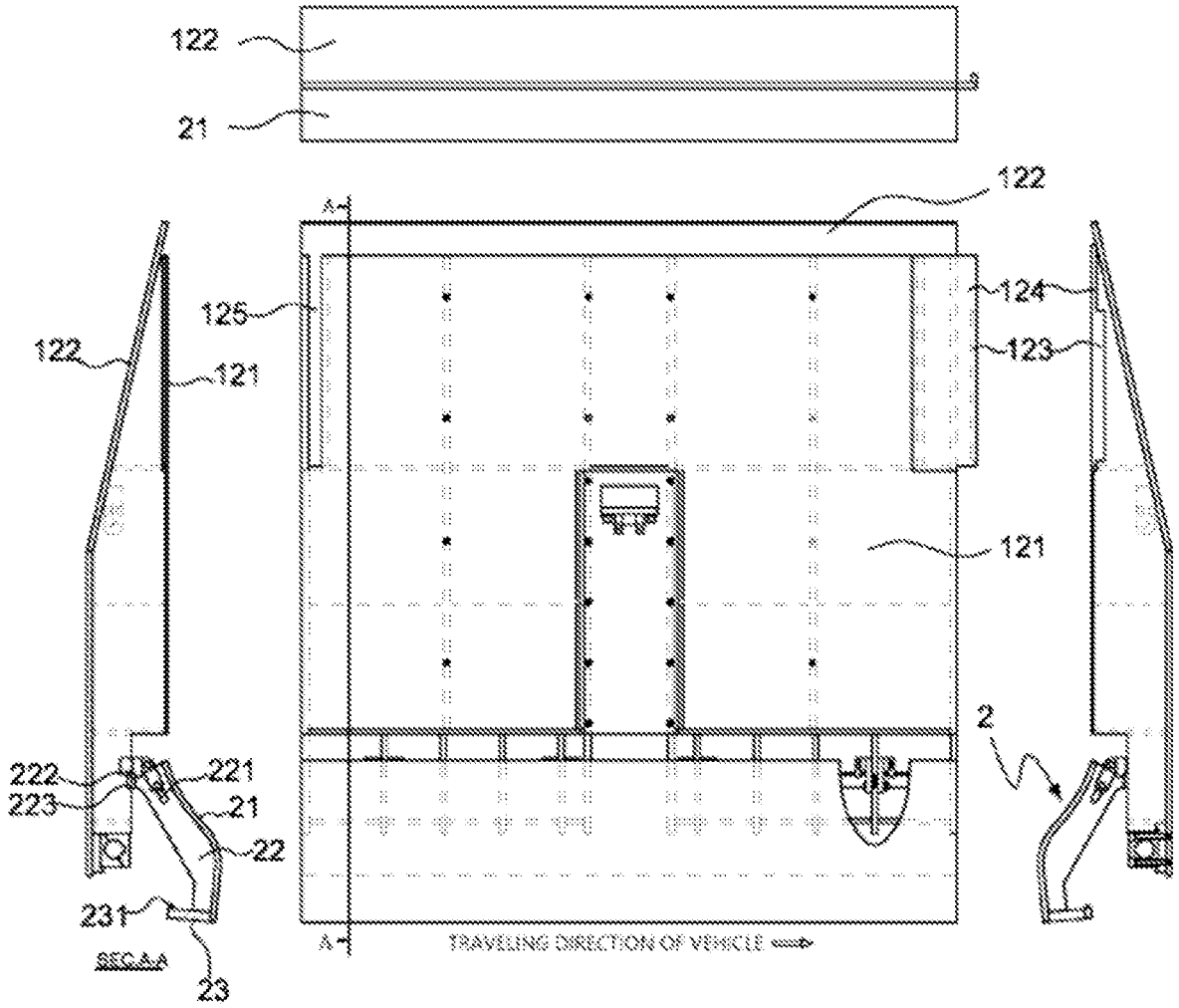
FIG. 4 is exemplified front, top, and side views illustrating a structure in which a front block part is fastened to a lower portion of each of the angle decks by a link unit according to the exemplary embodiment of the present disclosure.
Figure 5:
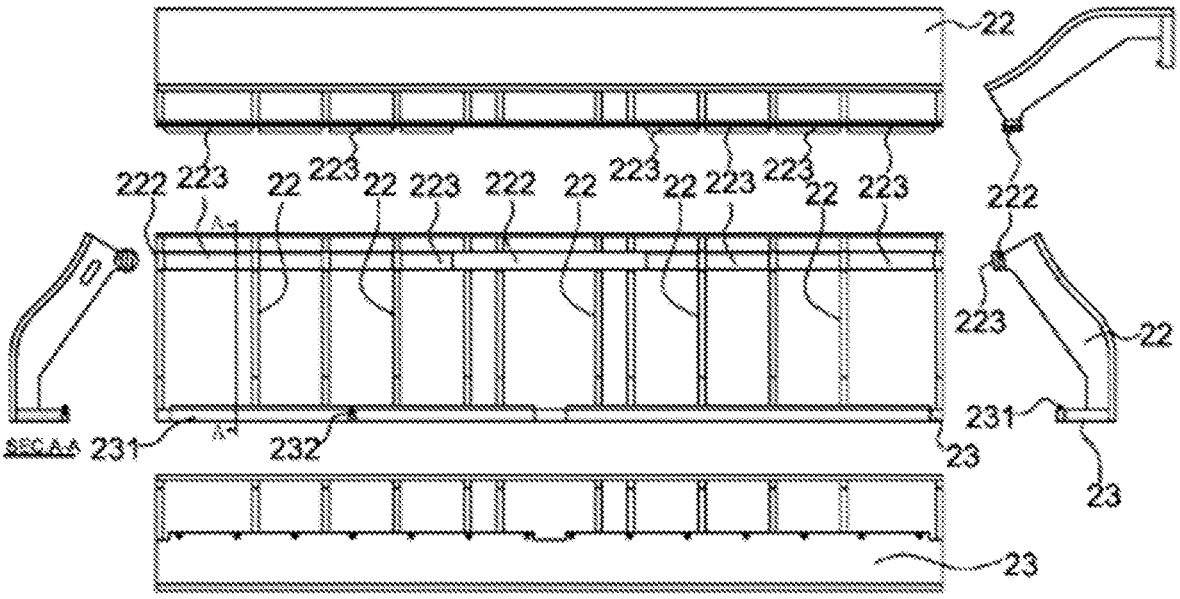
FIG. 5 is exemplified front, top, bottom, and side views illustrating a structure of the front block part according to the exemplary embodiment of the present disclosure.
Figure 6:
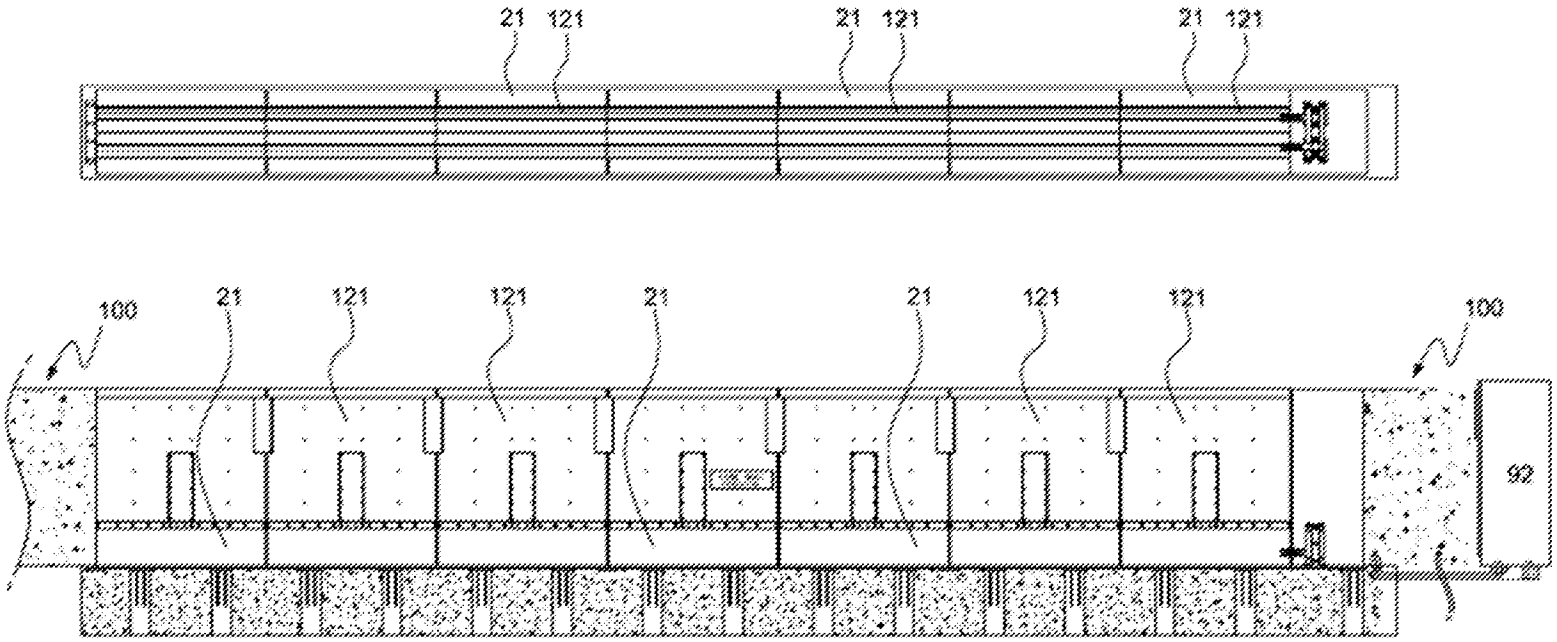
FIG. 6 is exemplified front and top views illustrating a structure of the emergency vehicle return apparatus at normal times according to the exemplary embodiment of the present disclosure in which a plurality of rotational decks is coupled.
Figure 7:
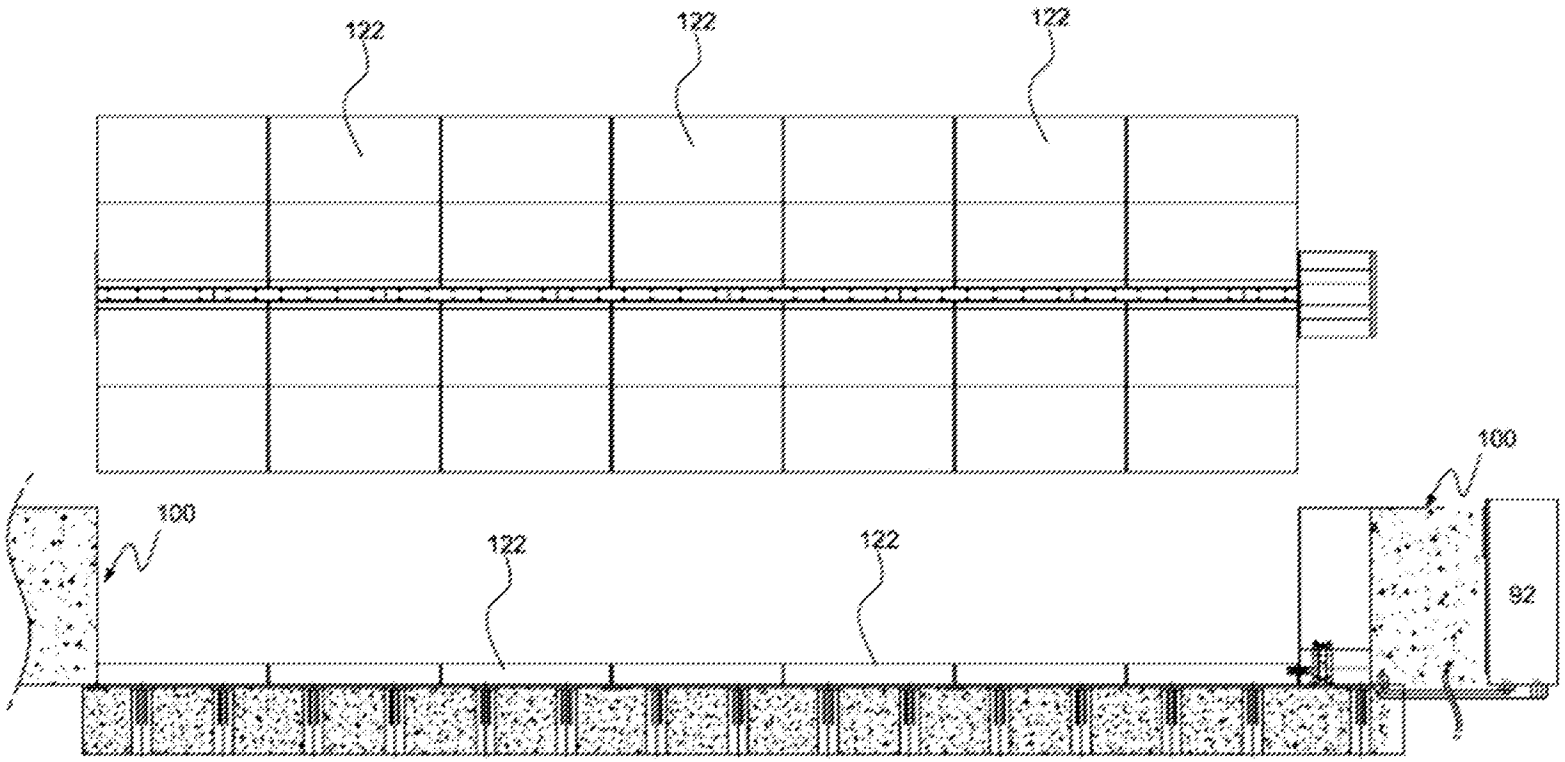
FIG. 7 is exemplified front and top views illustrating a structure of the emergency vehicle return apparatus in the event of emergency according to the exemplary embodiment of the present disclosure in which the plurality of rotational decks is coupled.
Figure 8:
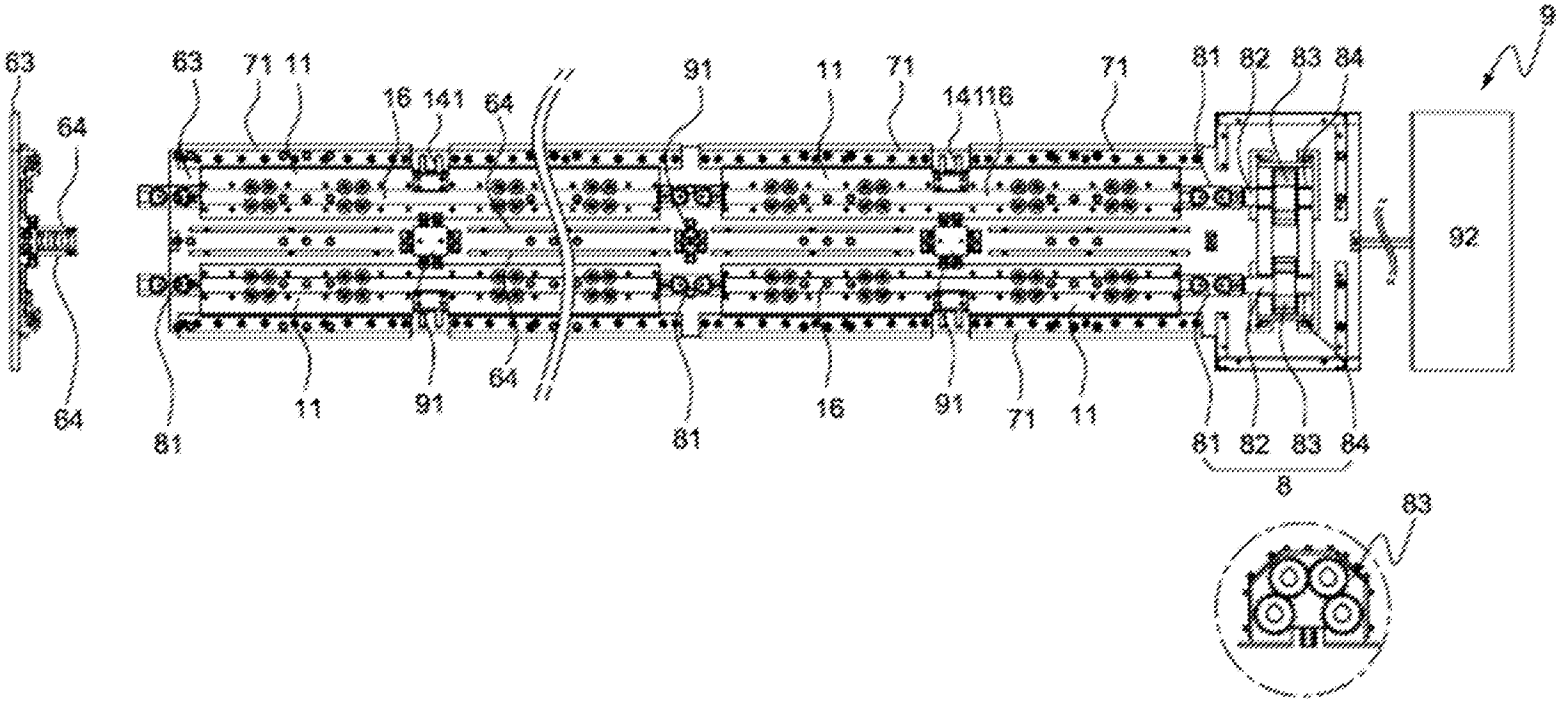
FIG. 8 is an exemplified top view illustrating a configuration of the rotational decks installed on a base plate according to the exemplary embodiment of the present disclosure.
Figure 9:
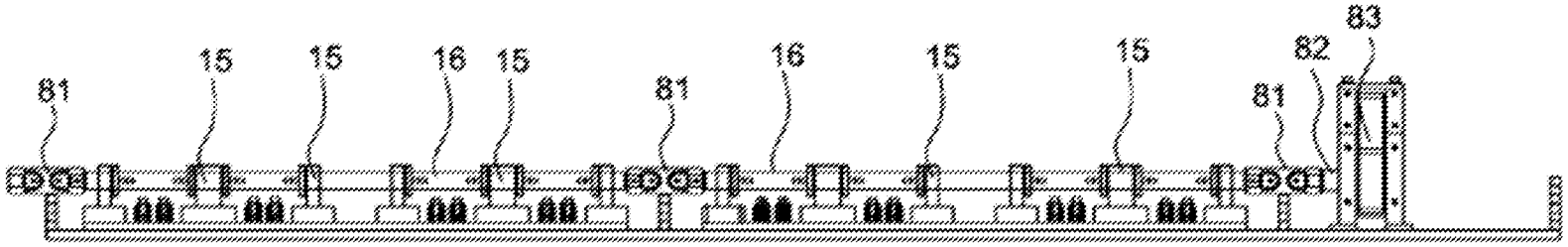
FIG. 9 is an exemplified front view illustrating a configuration of the rotational decks installed on the base plate according to the exemplary embodiment of the present disclosure.
Figure 10:
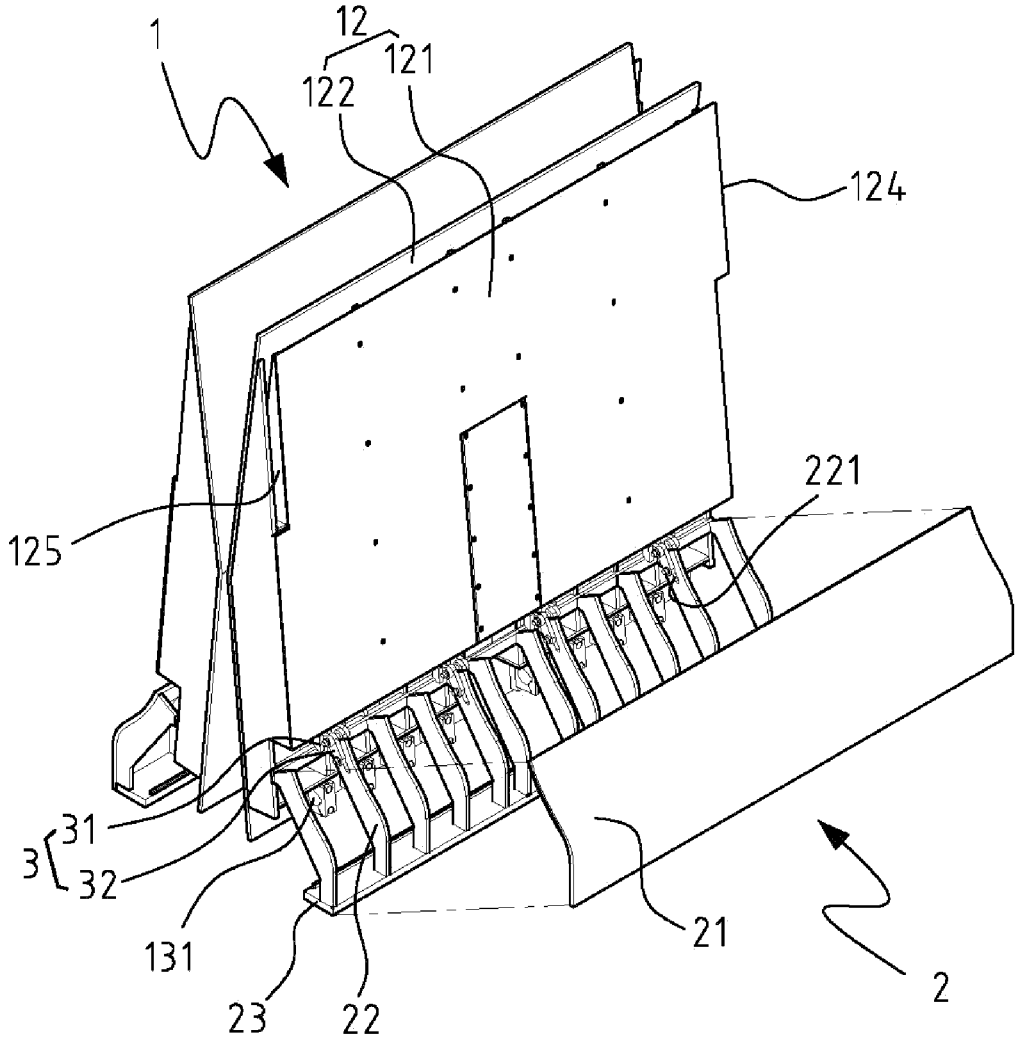
FIG. 10 is an exemplified prospective view illustrating a configuration of the rotational deck, the front block part and the link unit according to an exemplary embodiment of the present disclosure.
Figure 11:
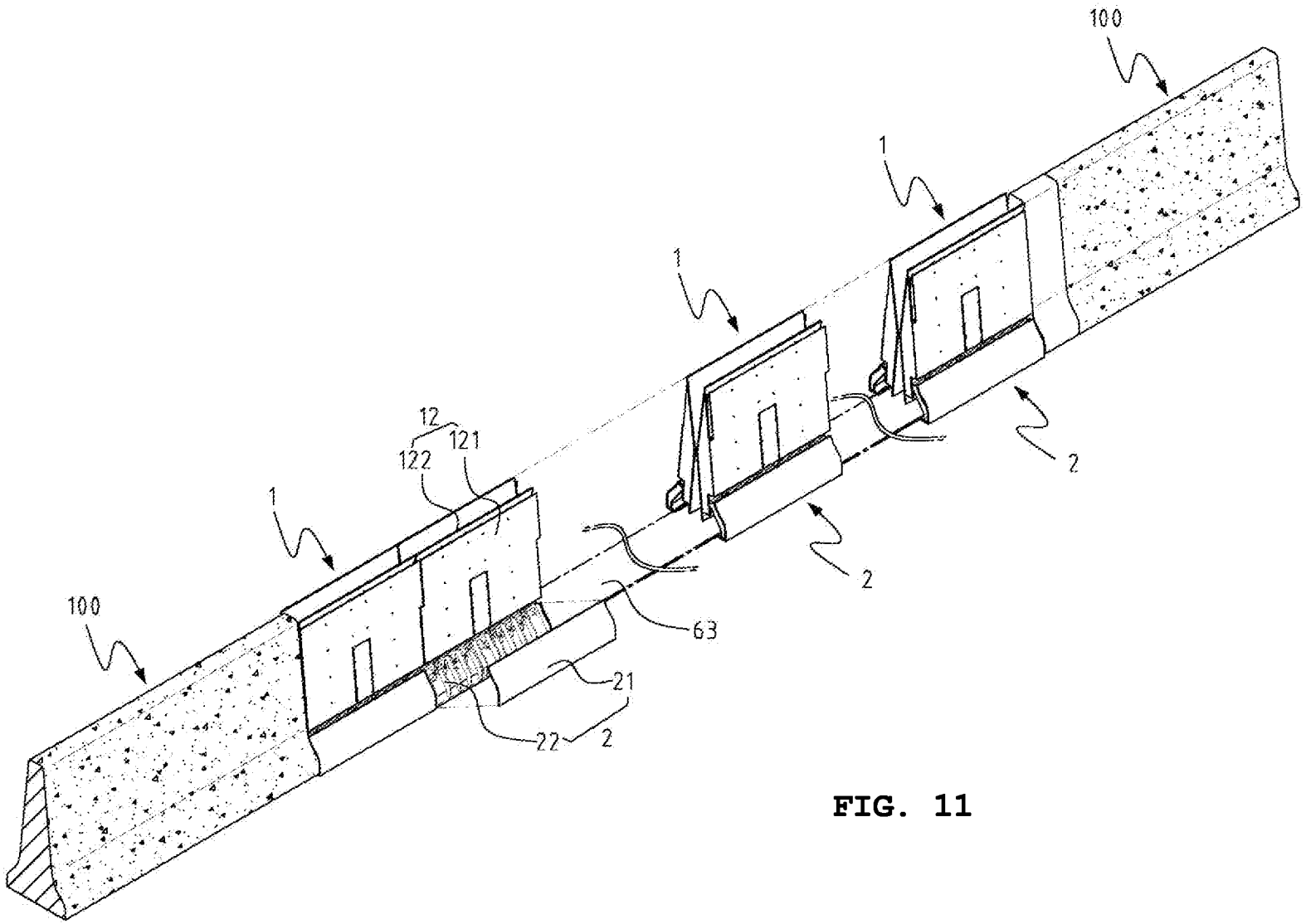
FIG. 11 is an exemplified prospective view illustrating a structure of the emergency vehicle return apparatus at normal times according to the exemplary embodiment of the present disclosure, in which rotational decks are folded up.
Figure 12:
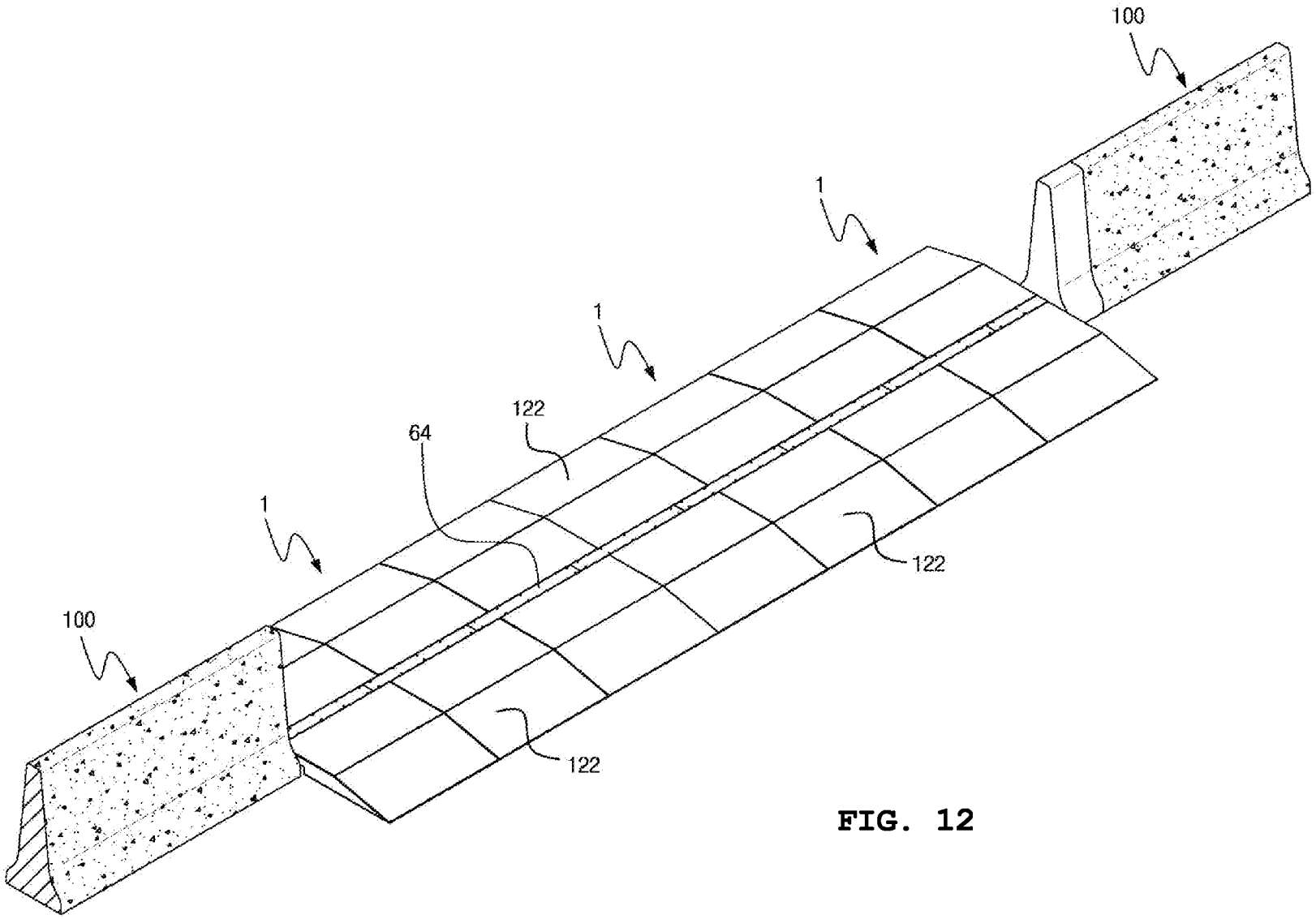
FIG. 12 is an exemplified prospective view illustrating a structure of the emergency vehicle return apparatus in the event of emergency according to the exemplary embodiment of the present disclosure, in which rotational decks are unfolded down.

FIG. 1 is an exemplified cross-sectional view illustrating a configuration of an emergency vehicle return apparatus according to an exemplary embodiment of the present disclosure, FIG. 2 is an exemplified cross-sectional view illustrating a structure in which the emergency vehicle return apparatus according to the exemplary embodiment of the present disclosure is constructed, FIG. 3 is an exemplified cross-sectional view illustrating a state in which rotational decks of the emergency vehicle return apparatus according to the exemplary embodiment of the present disclosure are rotated and disposed horizontally in the event of emergency, FIG. 4 is exemplified front, top, and side views illustrating a structure in which a front block part is fastened to a lower portion of each of the angle decks by a link unit according to the exemplary embodiment of the present disclosure, FIG. 5 is exemplified front, top, bottom, and side views illustrating a structure of the front block part according to the exemplary embodiment of the present disclosure, FIG. 6 is exemplified front and top views illustrating a structure of the emergency vehicle return apparatus at normal times according to the exemplary embodiment of the present disclosure in which a plurality of rotational decks is coupled, FIG. 7 is exemplified front and top views illustrating a structure of the emergency vehicle return apparatus in the event of emergency according to the exemplary embodiment of the present disclosure in which the plurality of rotational decks is coupled, FIG. 8 is an exemplified top view illustrating a configuration of the rotational decks installed on a base plate according to the exemplary embodiment of the present disclosure, FIG. 9 is an exemplified front view illustrating a configuration of the rotational decks installed on the base plate according to the exemplary embodiment of the present disclosure, FIG. 10 is an exemplified prospective view illustrating a configuration of the rotational deck, the front block part and the link unit according to an exemplary embodiment of the present disclosure, FIG. 11 is an exemplified prospective view illustrating a structure of the emergency vehicle return apparatus at normal times according to the exemplary embodiment of the present disclosure, in which rotational decks are folded up as illustrated in FIG. 6, and FIG. 12 is an exemplified prospective view illustrating a structure of the emergency vehicle return apparatus in the event of emergency according to the exemplary embodiment of the present disclosure, in which the rotational decks are unfolded down as illustrated in FIG. 7.

As illustrated, the emergency vehicle return apparatuses according to the present disclosure are installed at predetermined distances for each section of a median strip 100 constructed on a road. The emergency vehicle return apparatus has a pair of decks which is symmetrically spread toward two opposite roads to open the two opposite roads in the event of emergency, thereby allowing the vehicle on one road in an emergency situation to safely make a return other road.

To this end, the emergency vehicle return apparatus is provided with a rotational deck 1 configured such that a pair of angle decks, which is symmetrically installed to be operated in the event of emergency, is rotated by hydraulic cylinders, respectively, and adjoins left and right paved surfaces of the roads.

According to a basic configuration and an operational principle of the rotational deck 1, the rotational deck 1 includes; a compression plate 11 positioned on an upper portion of a base plate of a base part; a pair of angle decks symmetrically installed on an upper portion of the compression plate 11 and supported by a plurality of angle deck frames 13 positioned inside the pair of angle decks 12; and hydraulic cylinders 14 each having one end coupled to the angle deck 12 by a hinge 141 and the other end coupled to the compression plate 11 by the hinge 141 in order to rotate the angle decks 12 with hydraulic pressure.

The symmetrically configured pair of angle decks 12 includes outer and inner decks 121 and 122 supported by the plurality of angle deck frames 13 positioned inside the pair of the angle decks 12.

The outer deck 121 is a deck that serves as the median strip 100 at normal times when viewed from the road, and the outer deck 121 is formed in the form of a deck surface installed so that an upper portion thereof is inclined inward at a predetermined angle in order to prepare for a vehicle collision. The inner deck 122 is formed in the form of an inclined deck surface that becomes narrow outward from a lower portion thereof to an upper portion thereof from one section of the upper portion.

In addition, the plurality of angle deck frames 13 configured to support the angle decks 12 has shaft groove portions 131 at lower sides thereof, and angle deck rotational shafts 16 are axially coupled to the shaft groove portions 131 in a horizontal direction, such that the angle deck rotational shafts 16 are operated in conjunction with the adjacent angle decks 12.

When each of the angle decks 12 configured as described above is rotated in a left/right width direction of the road by adjusting the amount of hydraulic pressure supplied to the hydraulic cylinder 14 in the event of emergency and then adjoins the paved surface of the road, the outer deck 121 adjoins the paved surface of the road, and the inner deck 122 is placed above the outer deck 121, such that the vehicle moves upward on the angle deck 12 along an upward-inclined inner deck 122 from one side road and then moves downward along the other angle deck 12 along a downward-inclined inner deck 122.

In addition, the plurality of individual rotational decks 1 may be connected and installed in a longitudinal direction of the road in accordance with a length of the road, a gradient of the road, or flatness of the road. In this case, the emergency vehicle return apparatus may further include: a plurality of angle deck rotational shaft bushings 15 fastened to the upper portion of the compression plate 11 in order to cooperatively operate the respective adjacent rotational decks 1; and the angle deck rotational shafts 16 axially coupled to and penetrating, in the longitudinal direction, the shaft groove portions 131 formed in the plurality of angle deck frames 13 for supporting the respective angle deck rotational shaft bushings 15 and the respective angle decks 12. The angle deck rotational shaft 16 has keys corresponding to key grooves 132 of the shaft groove portions 131 and operates in conjunction with the rotation of the angle deck 12 by hydraulic pressure.

In addition, in the case in which the plurality of rotational decks 1 is provided, the angle deck 12 is connected to the adjacent angle deck 12 and cooperatively operated simultaneously as a connecting cover 124 having a catching projection 123 is installed or a catching groove 125 configured to be caught by a catching projection is installed at left and right sides of the outer deck 121. In this case, the angle decks 12 positioned at both ends may have only one of the connecting cover 124 and the catching groove 125 in accordance with left and right positions.

The compression plate 11 is configured by a rectangular metal plate, and a surface of the compression plate 11 has a plurality of fastening holes fastened to the plurality of angle deck rotational shaft bushings and the hydraulic cylinders, and has compressive spring support grooves for supporting compressive springs of a pressing/fixing part.

The plurality of angle deck rotational shaft bushings 15 installed on the upper portion of the compression plate 11 includes bushings and bushing fixing units fastened to the compression plate 11. In addition, the bushing may be provided in the form of a bearing, as necessary.

In addition, the angle deck rotational shafts 16, which constitute the rotational deck 1, are axially coupled by penetrating the angle deck rotational shaft bushings 15 between shaft groove portions 223 formed in the angle deck frames 13 at the lower sides of the angle decks 12. To this end, a plurality of key grooves is formed in the angle deck rotational shaft 16 and keys are inserted into the plurality of key grooves. The angle deck rotational shaft 16 is rotated in conjunction with the rotation of the angle deck 12, and the angle deck rotational shafts 16 of the adjacent rotational decks 1 are operated in conjunction with each other by universal joints that constitute a cooperation part.

In addition, the lower portion of the hydraulic cylinder 14 for rotating the angle deck 12 is hingedly coupled to the compression plate 11, and the upper portion of the hydraulic cylinder 14 is hingedly coupled to an inner surface of the inner deck 122 of the angle deck 12. A part of the outer deck 121 is cut out at a point at which the hydraulic cylinder 14 is installed, such that the hydraulic cylinder 14 does not interfere with the outer deck 121 when the hydraulic cylinder 14 operates.

Meanwhile, according to the present disclosure, a front block part 2 is provided to be cooperatively operated by being fastened to the lower portion of each of the angle decks 12 that constitute the rotational deck 1, and the front block part 2 serves as the median strip 100 at normal times when the rotational deck is not operated. The front block part 2 has a structure for reducing impact by allowing the vehicle to bounce out without being stopped in the event of a vehicle collision accident.

The front block part 2 is configured to be cooperatively operated by being fastened, by a link unit 3, to the lower portion of the angle deck frame 13 that supports each of the angle decks 12.

Since the front block part 2 has the structure designed to allow the vehicle to bounce out at an angle corresponding to a collision incident angle of the vehicle while a front portion of the vehicle is rotated, it is possible to reduce deformation of the structure of the emergency vehicle return apparatus and to reduce the amount of scattering fractured components generated at the time of a collision, and particularly, it is possible to reduce impact to be applied to an occupant in the vehicle caused by the collision during this process.

The front block part 2 includes: a front block 21 installed at a side toward the road and having a shape in which a lower portion thereof further protrudes toward the road than an upper portion thereof; one or more front block frames 22 configured to provide rigidity by supporting a rear surface (in an inner direction) of the front block 21 and fastened, at one point, to the link unit 3 installed on the one or more angle deck frames 13 for supporting the angle deck 12 of the rotational deck 1; and a bottom frame 23 configured to support the front block 21 and a lower portion of the front block frame 22.

Contact surfaces between the front block 21, the front block frame 22, and the bottom frame 23 are configured by welding basically. In addition to the welding, the front block 21, the front block frame 22, and the bottom frame 23 may be fastened by bolting, riveting, or the like.

The front block 21 is configured by one continuous unit steel plate or one welded steel plate and has a shape in which an outer lower section, which adjoins the road, protrudes or a shape processed along an external shape of the median strip 100.

For example, the shape in which the lower section protrudes is formed such that the lower section, based on the upper and lower sections, protrudes toward the road and is formed to have a protruding section such as a curvature or other polygonal cross section. An upper portion of the protruding section has a shape less protruding than the protruding section so that a wheel of the vehicle climbs up the protruding section at the time of a collision.

In addition, the shape processed along the external shape of the cross section of the median strip 100 is configured to have a cross-sectional structure having an inclined " 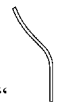 " shape in which a lower portion further protrudes in the direction of the road than an upper portion based on a lateral cross section (in a direction crossing the road) of the median strip 100 and a portion between a middle portion and an upper portion is curved inward from the middle portion to the upper portion such that the cross-sectional structure has a continuous shape with the median strip 100 which is an adjacent concrete structure.

In this case, the front block frame 22, which adjoins the rear surface of the front block part 2, is also formed to have the same shape, thereby securely supporting impact.

According to any one front block part 2 having the lateral cross-sectional structure described above, when an accident occurs in which the traveling vehicle collides with the median strip 100 at an angle orthogonal to the median strip 100 or an oblique angle, which is not the direction orthogonal to the median strip 100, the wheel at the collision side collides with and climbs up the protruding portion of the front block 21 of the front block part 2 at a side toward the road, such that a tire instantaneously loses a contact surface. Therefore, a differential gear, which distributes power to the two wheels of the vehicle, reduces or cuts off the power applied to the wheel at the collision side, which is idling, such that the vehicle naturally bounces out while being rotated by the other wheel that continues to receive the power.

Therefore, after the accident vehicle collides with the median strip 100 at a predetermined angle, the front portion of the accident vehicle rotates, without being stopped, at an angle with respect to the median strip 100, that is, an angle with respect to a normal line to an interface, such that the vehicle is separated from the median strip 100.

Therefore, the deformation of the structure of the emergency vehicle return apparatus and the amount of scattering fractured components, which are caused by the collision, are reduced, and particularly, impact caused by the collision is less transmitted to the vehicle, thereby achieving safety of the occupant.

The front block frame 22 has a long hole portion 221 that penetrates the surface in the direction orthogonal to the median strip 100. The front block frame 22 is linked to the link unit 3 installed on the angle deck frame 13, such that the state of the angle deck 12 varies in conjunction with the vertical or horizontal rotation, thereby moving upward or downward the front block 21 welded to the angle deck 12.

The plurality of front block frames 22 is arranged at positions corresponding to arrangement intervals between the angle deck frames 13 for supporting the angle deck 12, thereby preventing structural deformation or the like by supporting the front block 21 against external force applied to the front block 21.

In addition, the front block frame 22 is formed such that a horizontal deck frame 222, which connects the front block frames 22 adjacent to each other in an upper inward direction, is additionally formed by welding or fastening, and a plurality of left and right separation prevention protrusions 223 is formed by welding on an outer surface of the horizontal deck frame 222.

A length of each of the left and right separation prevention protrusions 223 is set to a length that allows the left and right sides to be inserted between the angle deck frames 13 for supporting the angle deck 12 and allows the left and right sides to come into contact with each other or approach each other so that the left and right movements are controlled.

Therefore, the left and right separation prevention protrusions may have an equal size or different lengths in accordance with a distance between the angle deck frames 13.

In addition, the horizontal deck frame 222 has an obliquely processed portion 222*a* formed by obliquely processing the rear portion of the upper surface (in the direction of the road) in order to avoid interference with the link unit 3 provided on the angle deck frame 13 when the left and right separation prevention protrusions 223 are inserted between the angle deck frames 13.

In this case, the link unit 3 corresponding to the obliquely processed portion 222*a* also has an obliquely processed fixing groove 31*a* provided in a lower portion (in the inner direction) of a block link 31 fixed to the front block frame 22.

Since the two opposite sides are obliquely processed as described above, the left and right separation prevention protrusions 223 are inserted between the angle deck frames 13 without interference, such that the left and right movements are controlled, and the obliquely processed portion 222*a* of the horizontal deck frame 222 is in surface-to-surface contact with the fixing groove 31*a* of the block link 31, which constitutes the link unit 3, at normal times, and as a result, the upper portion is stably fixed and supported.

The bottom frame 23 has a width (length) (based on the width direction of the median strip) further protruding inward than a width (length) of the front block frame 22, and a fixing protrusion 231 protruding upward again is formed in the longitudinal direction of the bottom frame 23 and at an end of the bottom frame in the inner direction.

The fixing protrusion 231 is inserted into a fixing groove 712 formed in the fixing block 71 that restricts a lifting height of the compression plate installed in the longitudinal direction of the base plate of the base part to which the rotational deck 1 is fastened, thereby preventing the withdrawal of the front block part 2 and fixing and supporting the lower portion. In this case, an inlet side of the fixing groove also has an obliquely processed shape in order to avoid interference with the inserted fixing protrusion 231.

In addition, the fixing protrusion 231 has therein an elastic stopper 232 installed at one point in the longitudinal direction, thereby implementing additional control. The elastic stopper 232 may be configured as a stopper having elastic force as long as the stopper is lowered by receiving external force and raised when the external force is eliminated.

The bottom frame also serves to cover an upper side of a receiving port at normal times.

The angle deck 12 and the front block part 2 are connected by the link unit 3 provided between the angle deck frame 13 constituting the angle deck 12 and the front block frame 22 constituting the front block part 2. Therefore, when the angle deck 12 is rotated by the operation of the hydraulic cylinder 14, the front block part 2 is moved upward or downward in conjunction with the rotation of the angle deck.

To this end, the link unit includes the block link 31 fixed to the angle deck frame 13 for supporting the angle deck, and a link 32 connected, at one side thereof, to the block link 31 by a pin and connected, at the other side thereof, by a pin, to the long hole portion 221 formed in the front block frame 22 for supporting the front block of the front block part.

The link unit 31 operates such that when the front block part 2 is raised, the long hole portion 221 formed in the front block frame 22 of the front block part 2 does not allow a load of the front block part 2 to be applied to the hydraulic cylinder 14, which rotates the angle deck 12, by a long hole length of the long hole portion for a predetermined period of time for which the link unit 31 is raised.

Therefore, the load is applied after the lifting force is increased as the sufficient hydraulic pressure is applied when a piston of the hydraulic cylinder 14 is extended, such that the angle deck 12 and the front block part 2 are rotated and raised even at the time of initial extension when a relatively small amount of hydraulic pressure is supplied.

The configuration described above advantageously reduces a size of the hydraulic cylinder 14 and improves durability of the hydraulic cylinder 14.

In addition, when the rotational deck 1 operates and the pair of angle decks is spread toward two opposite sides of the road, the front block part 2 is lowered so that receiving ports 5 constructed in advance in the longitudinal direction of the median strip 100 is provided and stored in the vicinity of the base part constructed on the ground.

In this case, a sealing part 51 including a sealing member 51*a* having elastic force and a support member 51*b* constructed on the concrete of the base part in order to fix the sealing member is installed at one side of an upper portion of the receiving port 5 and in the longitudinal direction of the road. The sealing part 51 is resiliently in contact with the front block 21 at normal times, thereby maximally preventing an inflow of dust and rainwater. The sealing member 51*a* and the support member 51*b* may particularly be configured by a length material having an extruded cross-sectional shape.

In addition, drain ports for vertical drain are provided at a lower side of the receiving port 5 at one or more points in the longitudinal direction, such that the introduced dust or rainwater is discharged to a main drain port that communicates with a horizontal drain port that constitutes the base part positioned at a lower side thereof.

Hereinafter, the remaining components of the emergency vehicle return apparatus will be described.

The emergency vehicle return apparatus installed for each section of the median strip 100 according to the present disclosure has the base part 6 fastened to the rotational deck and constructed under the ground where the rotational deck 1 is positioned.

In addition, the emergency vehicle return apparatus has a pressing/fixing part 7 configured to fix the rotational deck 1 to the base part by elastically pressing the rotational deck 1 and to restrict a lifting height of the rotational deck 1 while providing buffer power when a local load of the vehicle is applied.

In addition, the emergency vehicle return apparatus has a cooperation part 8 that allows the plurality of individual rotational decks 1 to operate in conjunction with one another in accordance with a difference in height of the paved surface of the road.

In addition, the emergency vehicle return apparatus has a power control unit 9 that remotely controls a supply of hydraulic pressure and power required to operate the rotational deck 1 in a wired or wireless manner.

The base part 6 is constructed in one section of the median strip 100. The median strip 100 may be constructed together with the emergency vehicle return apparatus according to the present disclosure, or the emergency vehicle return apparatus may be constructed under the ground in a required section of the median strip 100 constructed in advance after the median strip 100 is cut out.

The base part is installed by excavating a section length of the median strip 100, where the emergency vehicle return apparatus is installed, with a predetermined area and depth in a direction of the two opposite sides of the road, constructing the drain ports 61, arranging a plurality of steel pipe pile 62 above the drain ports 61 in the longitudinal direction of the median strip 100, installing molds, and then pouring concrete.

Thereafter, when the concrete is cured, one base plate 63 is positioned on an upper end head of each of the steel pipe piles 62 and fastened and integrally coupled by bolting.

Above the base plate 63, there are installed the compression plate 11 which constitutes the rotational deck 1, the pressing/fixing part 4 which fixes the compression plate, and a hydraulic pressure distributor which distributes hydraulic pressure supply lines for supplying hydraulic pressure to the hydraulic cylinders 14 that rotates the two angle decks 12 of the rotational deck 1.

In addition, the base plate 63 has a plurality of pairs of hydraulic line protectors 64 installed for each section, in which no hydraulic pressure distributor is installed, in the longitudinal direction of the central portion, thereby stably protecting the plurality of hydraulic pressure supply lines and supplying the hydraulic pressure to the hydraulic pressure distributor. After the hydraulic pressure supply lines are constructed in the hydraulic line protector 64, a cover is fastened to an upper portion of the hydraulic line protector 64 to protect the hydraulic line protector.

A length of the base plate 63 may be at least set to a length by which the emergency vehicle return apparatus for a median strip according to the present disclosure is constructed, such that supporting force of each of the steel pipe piles 62 may be applied to one base plate 63 to implement high fixing force.

When the base plate 63 is installed, high fixing/supporting force is provided when the rotational deck 1 installed on the upper portion of the base plate is rotated or when the rotational deck 1 is maintained in a fixed state at normal times.

Meanwhile, in order to construct the base part 6, the concrete is poured in a state in which the receiving ports 5 are also symmetrically inserted into the ground at both sides along the construction part of the emergency vehicle return apparatus at both sides of the steel pipe piles 62.

The pressing/fixing part 7 is configured to fix the base plate 63 of the rotational deck 1 to the base part 6 by elastically pressing the base plate and to restrict the lifting height of the rotational deck 1 while providing buffer power when a local load of the vehicle is applied.

To this end, the pressing/fixing part 7 includes fixing blocks 71 installed at both ends in the longitudinal direction of the base plate and configured to restrict the lifting height of the compression plate, and compressive spring units 72 configured to elastically press the compression plate.

The fixing block 71 has, at one side thereof, a projection 711 so that the compression plate 11 is caught by the projection 711 when the compression plate 11 is raised as a local load of the vehicle is applied. The fixing block 71 has, at the other side thereof, a fixing groove 712 into which a fixing protrusion 231 formed on the bottom frame 23 is inserted and supported at normal times.

The compressive spring unit 72 may include a compressive spring 721 configured to press the compression plate 11, an upper end support part 722 configured to support an upper end of the compressive spring, and a bolt 723 fixed to the base plate 63 by penetrating a hole formed at a center of the upper end support part.

The compressive spring may be configured in the form of a disc spring to smoothly provide compressive and extensive force in a narrow vertical space. The compressive spring is configured to press and elastically support the compression plate 11 that maintains the surface-to-surface contact state with the base plate 63.

The operation of the pressing/fixing part 7 and the reason why the pressing/fixing part 7 is required will be described in more detail. There is a problem in that the compression plate 11 is maintained in a state of being spaced apart and lifted upward from the base plate 63 when the angle deck 12 is rotated or a local load of the vehicle is applied in a state in which the adjacent rotational decks 1 have a difference in height in accordance with a difference in height in the longitudinal direction of the median strip.

For this reason, the compression plate 11, which fastens the rotational deck 1 to the base plate 63, serves to fix the pair of angle decks 12 by being fastened to the lower portions of the pair of angle decks, and the compressive spring of the pressing/fixing part 7 fastened to the base plate 63 of the base part 6 elastically supports the compression plate 11 by pressing the compression plate 11 while maintaining a state in which the compression plate maintains surface-to-surface contact with the base plate 63, which is positioned below the compression plate, without being fastened directly to the base plate 63 by a fastening means.

The cooperation part 8 includes: universal joints 81 configured to connect the angle deck rotational shafts 16 provided in the individual rotational decks 1; a pair of gear shafts 82 coupled to the pair of universal joints of the rotational deck 1 positioned at one end among the plurality of rotational decks 1; cooperative gear units 83 axially coupled to the gear shafts and gear-coupled to adjacent gears; and gear bushings 84 configured to support the gear shafts, respectively.

The cooperative gear units may be gear-coupled directly to the adjacent gears or gear-coupled to the adjacent gears by further including a plurality of gears therebetween.

In addition, the cooperative gear units may be independently provided at both ends when the number of rotational decks is increased in some instances.

In addition, the cooperative gear unit may be received in a casing having a shape corresponding to a shape of the median strip.

When the cooperation part is provided as described above, the plurality of adjacent rotational decks 1 is always uniformly operated in conjunction with one another by the universal joints and the cooperative gears even though a non-uniform operation occurs as different hydraulic pressures are applied to the hydraulic cylinders for rotating the angle decks of the respective rotational decks.

The power control unit 9 is configured to remotely control the supply of hydraulic pressure and power required to operate the rotational deck in a wired or wireless manner, such that a manager need not go to the emergency vehicle return apparatus installed on the median strip by crossing the road in order to manipulate the emergency vehicle return apparatus in the event of emergency.

To this end, the power control unit includes a control board 92 including a control panel including a hydraulic pressure distributor 91 configured to distribute hydraulic pressure to the hydraulic pressure supply lines for providing hydraulic pressure, a hydraulic pump, a power source device, and a wired or wireless remote control module. The control panel may not only be remotely controlled in a wired or wireless manner, but also controlled manually. A description of a specific configuration or circuit will be omitted because the wired or wireless remote control module may use well-known control methods using various communication modules.

The hydraulic pressure distributor 91 has therein multiple hydraulic pressure paths, and the hydraulic pressure distributor is installed for each point at which hydraulic cylinders and stopper cylinders are positioned in order to supply hydraulic pressure to necessary parts in multiple manners.

The hydraulic pump installed on the control board is configured to operate by receiving power from an external power source or its own power source. In a case in which the power source device is an external power source, the power source device may be connected directly to the hydraulic pump, or the hydraulic pump may be operated by receiving electricity stored in a battery. In addition, the power source of the hydraulic pump may be configured such that electricity generated from environmentally-friendly renewable energy such as solar cells, wind power, or the like is connected directly to the hydraulic pump, or the hydraulic pump may be operated by receiving electricity stored in the battery.

The control board is configured to control the supply of hydraulic pressure and power and the operation of the rotational deck 1 by manipulating the control panel.

In consideration of a road situation or the like, an installation position of the control board may be selectively set on a side of the median strip, or the control board may be installed at a separate point spaced apart from a shoulder of the road in order to supply hydraulic pressure and power.

The respective components of the emergency vehicle return apparatus according to the present disclosure are made of metal, synthetic resin, or steel-reinforced concrete basically having rigidity.

Hereinafter, an operation of the present disclosure configured as described above will be described.

In a case in which an accident occurs in which the vehicle traveling on the road collides with the front block part 2, which is positioned at the lower side of the angle deck 12 that constitutes the rotational deck 1 at normal times, at an oblique angle to the median strip, the wheel at the collision side collides with and climbs up the protruding portion of the front block 21 of the front block part 2 at a side toward the road, such that a tire instantaneously loses a contact surface. Therefore, a differential gear, which distributes power to the two wheels of the vehicle, reduces or cuts off the power applied to the wheel at the collision side, which is idling, such that the vehicle naturally bounces out while being rotated by the other wheel that continues to receive the power. Therefore, after the accident vehicle collides with the median strip at a predetermined angle, the front portion of the accident vehicle rotates, without being stopped, at an angle with respect to the median strip, that is, an angle with respect to a normal line to an interface, such that the vehicle is separated from the median strip. With this process, the deformation of the structure of the emergency vehicle return apparatus and the amount of scattering fractured components, which are caused by the collision, are reduced, and particularly, impact caused by the collision is less transmitted to the vehicle, thereby achieving safety of the occupant.

In a case in which it is necessary to allow the vehicle to go back to the opposite road by emergently operating the shock-reducing emergency vehicle return apparatus for a median strip in the event of emergency, the power control unit is remotely controlled in a wired or wireless manner to supply hydraulic pressure and power, and the angle decks 12 are rotated downward as the piston is retracted as oil inputted to the hydraulic cylinders 14 installed in the plurality of rotational decks 1 is discharged to a hydraulic pressure tank, such that the outer decks 121 are brought into contact with the paved surface of the road, and the vehicle safely moves through the inner decks 122 positioned above the outer decks.

In this case, when the angle decks 12 are rotated downward, the angle deck rotational shafts 16 provided on the angle decks 12 are simultaneously rotated in conjunction with the rotations of the angle decks, the angle deck rotational shafts connected with the universal joints are continuously rotated, and the cooperative gear units axially coupled to the rotational deck 1 installed at one end among the plurality of rotational decks are operated, such that the pair of left and right angle decks 12, which are configured symmetrically and constitute the rotational deck 1, are rotated uniformly in conjunction with each other.

In a case in which some of the rotational decks 1 are spaced apart and lifted up from the paved surface of the road as a difference in height occurs in the longitudinal direction of the paved surface of the road or a local load of the vehicle is applied to the angle decks 12, the rotational decks 1 are stably operated in accordance with the difference in height by the universal joints 81 of the cooperation part 8 for connecting the angle deck rotational shafts 16 and the gear shafts and by the compressive spring units 72 that constitute the pressing/fixing part 7.

The present disclosure is not limited to the specific exemplary embodiment described above, various modifications can be made by any person skilled in the art to which the present disclosure pertains without departing from the subject matter of the present disclosure as claimed in the claims, and the modifications are within the scope defined by the claims.

What is claimed is:

1. A rotational deck configured to be installed for an emergency vehicle return apparatus at a section of a median strip of a road, the rotational deck comprising:

a pair of angle decks configured to be folded up and unfolded down by hydraulic cylinders, wherein the pair of angle decks serve as the median strip when they are folded up and serve as a vehicle pass when they are unfolded down toward a surface of the road;

a front block part coupled, by a link unit, to a lower portion of each angle deck of the pair of angle decks, wherein the front block part includes a front block having a lower portion and an upper portion, wherein the lower portion protrudes further outward relative to each angle deck than the upper portion to reduce a shock from a collision.

2. The rotational deck of claim 1, wherein the front block part further includes:

one or more front block frames configured to support a rear surface of the front block and coupled to the link unit installed on one or more angle deck frames; and a bottom frame configured to support the front block and a lower portion of the one or more front block frames.

3. The rotational deck of claim 2, further including a horizontal deck frame for supporting an upper part of the one or more front block frames; and a plurality of left and right separation prevention protrusions formed on an outer surface of the horizontal deck frame and inserted between the angle deck frames for supporting the angle deck, wherein the horizontal deck frame has an obliquely processed portion formed at a rear portion of an upper surface.

4. The rotational deck of claim 2, wherein the bottom frame has a width wider than a width of a front block frame such that the bottom frame protrudes further inward than the front block frame, and wherein a fixing protrusion is formed at an end of the bottom frame and configured to be inserted into a fixing groove formed in a fixing block, the fixing block being installed on a base plate of a base part of the emergency vehicle return apparatus.

5. The rotational deck of claim 1, wherein the link unit includes:

a block link fixed to an angle deck frame for supporting the angle deck; and a link connected, at one side of the link, to the block link by a pin and connected, at the other side of the link, by a pin, to a front block frame.

6. The rotational deck of claim 5, wherein the link is fastened to a long hole portion formed in the front block frame.

7. The rotational deck of claim 1, wherein the each angle deck includes an outer deck and an inner deck supported by a plurality of angle deck frames positioned inside the each angle deck, wherein the outer deck has an upper portion inclined inward at a predetermined angle, wherein the inner deck has an upper portion inclined outward, and wherein the angle deck frames include shaft groove portions at lower sides of the angle deck frames and angle deck rotational shafts axially coupled to the shaft groove portions in a horizontal direction.

8. The rotational deck of claim 1, wherein the angle deck includes one or both of a connecting cover and a catching groove, and wherein the connecting cover has a catching projection, and the catching groove is configured to be coupled to the catching projection of a neighboring angle deck.

* * * * *